US006923016B2

(12) United States Patent
Funakoshi et al.

(10) Patent No.: US 6,923,016 B2
(45) Date of Patent: Aug. 2, 2005

(54) REFRIGERATION CYCLE APPARATUS

(76) Inventors: Sunao Funakoshi, c/o Hitachi, Ltd., Intellectual Property Group New Marunouchi Bldg. 5-1, Marunouchi 1-chome, Chiyoda-ku, Tokyo 100-8220 (JP); Hirokatsu Kohsokabe, c/o Hitachi, Ltd., Intellectual Property Group New Marunouchi Bldg. 5-1, Marunouchi 1-chome, Chiyoda-ku, Tokyo 100-8220 (JP); Kazuhiro Endoh, c/o Hitachi, Ltd., Intellectual Property Group New Marunouchi Bldg. 5-1, Marunouchi 1-chome, Chiyoda-ku, Tokyo 100-8220 (JP); Kenji Tojo, c/o Shimizu Works, Hitachi Air Conditioning Systems Co., Ltd. 390 Shimizumuramatsu, Shizuoka-shi, Shizuoka-ken 424-0926 (JP); Hiroaki Matsushima, c/o Hitachi, Ltd., Intellectual Property Group New Marunouchi Bldg. 5-1, Marunouchi 1-chome, Chiyoda-ku, Tokyo 100-8220 (JP)

( * ) Notice: Subject to any disclaimer, the term of this patent is extended or adjusted under 35 U.S.C. 154(b) by 0 days.

(21) Appl. No.: 10/819,181

(22) Filed: Apr. 7, 2004

(65) Prior Publication Data

US 2004/0200233 A1 Oct. 14, 2004

(30) Foreign Application Priority Data

Apr. 9, 2003 (JP) ..... 2003-104767

(51) Int. Cl.[7] ..... F25B 13/00

(52) U.S. Cl. ..... 62/324.1; 62/172; 62/228.3; 62/623

(58) Field of Search ..... 62/324.1, 613, 62/619, 623, 172, 210, 211, 228.3

(56) References Cited

U.S. PATENT DOCUMENTS

| | | | | |
|---|---|---|---|---|
| 6,321,564 | B1 | 11/2001 | Yamanaka et al. | |
| 6,449,983 | B2 * | 9/2002 | Pozivil | 62/613 |
| 6,484,519 | B1 | 11/2002 | Hesse et al. | |
| 6,487,877 | B1 * | 12/2002 | Griffiths et al. | 62/643 |
| 6,560,989 | B1 * | 5/2003 | Roberts et al. | 62/623 |
| 6,581,409 | B2 * | 6/2003 | Wilding et al. | 62/613 |

FOREIGN PATENT DOCUMENTS

| | | | |
|---|---|---|---|
| EP | 1046869 | 10/2000 | |
| FR | 1113372 | 3/1956 | |
| GB | 2242261 | 9/1991 | |
| JP | 11063707 | 3/1999 | |
| JP | 2001-66006 | 3/2001 | F25B/13/00 |
| JP | 2002-22298 | 1/2002 | F25B/1/00 |

* cited by examiner

*Primary Examiner*—Melvin Jones
(74) *Attorney, Agent, or Firm*—Antonelli, Terry, Stout & Kraus, LLP

(57) ABSTRACT

In a refrigerant cycle apparatus, an energy-saving operation is performed by using a refrigerant which is used in a supercritical state. A refrigeration cycle apparatus is constituted by a main compressor, an expander, a sub compressor independently placed in an upstream side of the main compressor, a use side heat exchanger, a heat source side heat exchanger and the like. A refrigerant such as a carbon dioxide or the like which is used in a supercritical state is employed as the refrigerant. The sub compressor is driven by utilizing a recovered energy by the expanding device. Further, a refrigerant tank is provided, and properly controls an amount of the refrigerant circulating in the refrigerant cycle.

7 Claims, 3 Drawing Sheets

REFRIGERATION CYCLE APPARATUS

BACKGROUND OF THE INVENTION

1. Field of the Invention

The present invention relates to a refrigeration cycle apparatus provided with a compressor, a use side heat exchanger, a heat source side heat exchanger and an expander, and more particularly to a refrigeration cycle apparatus in which carbon dioxide is employed as a refrigerant constituting a refrigeration cycle.

2. Description of Prior Art

As the refrigeration cycle apparatus provided with the expander, there are, for example, structures described in JP-A-2002-22298 (patent document 1) and JP-A-2001-66006 (patent document 2). In the structure described in the patent document 1, an energy recovered by the expander is used as an auxiliary power of the compressor. Further, in the structure described in the patent document 2, a direction of the refrigerant flowing through the expander is fixed in both of a cooling operation and a heating operation.

In the prior arts mentioned above, since the expander and the compressor are integrally formed, a heat leak from the compressor to the expander is large, so that there is a defect that an efficiency of the refrigeration cycle apparatus is lowered.

Further, in both of the cooling operation and the heating operation in the refrigeration cycle apparatus, it is not considered to keep a pressure difference between the inlet and the outlet of the expander and an amount of the refrigerant flowing through the expander proper. Accordingly, there is a problem that the efficiency is lowered.

There is a case that a two-stage compressor is employed as the compressor, however, this case does not consider a matter that a discharge pressure of a first stage compression portion (a suction pressure of a second stage compression portion) is set to a proper pressure. Accordingly, the efficiency of the compressor may be lowered.

Further, it is not considered to properly control an amount of the refrigerant circulating in the refrigerant cycle. Accordingly, there is a problem that the efficiency of the refrigeration cycle is lowered in the case that the refrigerant circulating amount is improper.

BRIEF SUMMARY OF THE INVENTION

A first object of the present invention is to improve an efficiency of a refrigeration cycle apparatus by reducing a heat leak from a compressor to an expander.

A second object of the present invention is to keep a pressure difference in the vicinity of the expander and an amount of a refrigerant flowing through the expander proper.

A third object of the present invention is to set a discharge pressure of a first stage compression portion (a suction pressure of a second stage compression portion) to a proper pressure, in a structure in which a two-stage compressor is employed as the compressor.

A fourth object of the present invention is to properly control an amount of the refrigerant circulating in the refrigeration cycle.

In order to achieve the first object mentioned above, in accordance with the present invention, there is provided a refrigeration cycle apparatus comprising:

a first compressor;

an expander;

a second compressor directly connected to a rotation axis of the expander;

a use side heat exchanger; and a heat source side heat exchanger, wherein the second compressor is provided in an upstream side of the first compressor.

In accordance with the structure mentioned above, since the second compressor directly connected to the expander is provided in the upstream side of the first compressor corresponding to a main compressor, it is possible to make a compression ratio of the second compressor and it is possible to restrict a discharge temperature of the second compressor low. Accordingly, since it is possible to make a temperature difference between the expander and the second compressor small, it is possible to reduce the heat leak from the second compressor to the expander.

In order to achieve the second object mentioned above, in accordance with the present invention, there is provided a refrigeration cycle apparatus comprising:

a first compressor;

an expander;

a second compressor directly connected to a rotation axis of the expander;

a use side heat exchanger;

a heat source side heat exchanger;

a four-way valve; and the refrigeration cycle apparatus changing a cooling operation and a heating operation of the use side heat exchanger by means of the four-way valve, wherein a refrigeration cycle is constituted by sequentially connecting the first compressor, the four-way valve, the heat source side heat exchanger, the expander, the use side heat exchanger and the second compressor, wherein the refrigeration cycle is provided with a first expansion valve arranged between the expander and the heat source side heat exchanger, and a second expansion valve arranged between the expander and the use side heat exchanger, and wherein a rectifying means for always circulating a refrigerant in an inlet side of the expander is provided between the first and second expansion valves and the expander.

Accordingly, in both of the cooling and heating operations, it is possible to fix the direction of the refrigerant flowing through the expander, and it is possible to keep the pressure difference between the inlet and the outlet of the expander proper.

In this case, it is desirable to connect between the first expansion valve in the side of the heat source side heat exchanger and the second expansion valve in the side of the use side heat exchanger, via a third expansion valve. In accordance with the structure mentioned above, since it is possible to regulate not only the pressure difference in the vicinity of the expander, but also a flow rate of the refrigerant flowing through the expander, it is possible to achieve a higher efficiency of the expander.

Further, the refrigerant cycle apparatus can be controlled at a higher efficiency, by fully opening any one of the first expansion valve and the second expansion valve and fully closing the third expansion valve in the case that a difference between a suction temperature of the second compressor and a saturation temperature in correspondence to a suction pressure of the second compressor is equal to or less than a predetermined value, and fully opening both of the first expansion valve and the second expansion valve and adjusting the third expansion valve to the other opening ratio (ratio of opening area) than the fully closed opening ratio in the case that the difference between the suction temperature of the second compressor and the saturation temperature in correspondence to the suction pressure of the second compressor is equal to or more than the predetermined value.

In order to achieve the third object mentioned above, in accordance with the present invention, there is provided a refrigerant cycle apparatus comprising:

a two-stage compressor having a first stage compression portion and a second stage compression portion;

a use side heat exchanger;

a pressure reducing apparatus;

a heat source side heat exchanger;

a four-way valve; and the refrigeration cycle apparatus changing a cooling operation and a heating operation of the use side heat exchanger by means of the four-way valve, wherein a discharge flow passage of the first stage compression portion of the two-stage compressor is branched, one is connected to a suction flow passage of the second stage compression portion, and another is connected to a flow passage changing means such as a three-way valve or the like for changing a flow passage to the use side heat exchanger and a flow passage to the heat source side heat exchanger.

As mentioned above, since the discharge flow passage of the first stage compression portion is branched, one is connected to the suction flow passage of the second stage compression portion and another is connected to the flow passage changing means, thereby changing the flow passage to the heat source side heat exchanger and the flow passage to the use side heat exchanger, it is possible to keep an intermediate pressure between the first stage and the second stage in the two-stage compressor proper.

In order to achieve the fourth object mentioned above, in accordance with the present invention, there is provided a refrigerant cycle apparatus comprising:

a compressor;

a use side heat exchanger;

a heat source side heat exchanger; and an expanding means, wherein the refrigeration cycle apparatus comprises:

a refrigerant tank provided in parallel to the expanding means;

two flow passages for taking in and out the refrigerant with respect to the refrigerant tank;

valves respectively provided in the flow passages;

a temperature detecting device provided in an outlet side of the heat source side heat exchanger at a time of a cooling operation, or in an outlet side of the use side heat exchanger at a time of a heating operation;

a pressure detecting device for detecting a discharge pressure of the compressor; and a control apparatus for opening and closing the two valves or controlling opening ratio of the two valves on the basis of a temperature detected by the temperature detecting device, and a pressure detected by the pressure detecting device.

As mentioned above, since the structure is made such that two valves respectively provided in two flow passages taking in and out the refrigerant with respect to the refrigerant tank are opened and closed or controlled in the opening ratio on the basis of the detected temperature and pressure, it is possible to change a total amount of the refrigerant circulating in the refrigerant cycle, and it is possible to control the discharge pressure of the compressor in such a manner that the efficiency of the refrigerant cycle apparatus becomes highest.

In this case, in the structure mentioned above, the structure may be made such that a gas-liquid separator is provided in an outlet of the expanding device and a flow passage for injecting a gas separated by the gas-liquid separator to the first compressor is provided. Further, in the refrigeration cycle apparatus structured in the manner mentioned above, it is particularly effective to employ carbon dioxide as the used refrigerant. In other words, in the case of using the carbon dioxide refrigerant, the heat radiation side is used under a supercritical pressure, so that it is possible to increase an energy recovery amount by the expanding device, and this structure is particularly effective.

Other objects, features and advantages of the invention will become apparent from the following description of the embodiments of the invention taken in conjunction with the accompanying drawings.

DESCRIPTION OF THE PREFERRED EMBODIMENT

Figure 1:
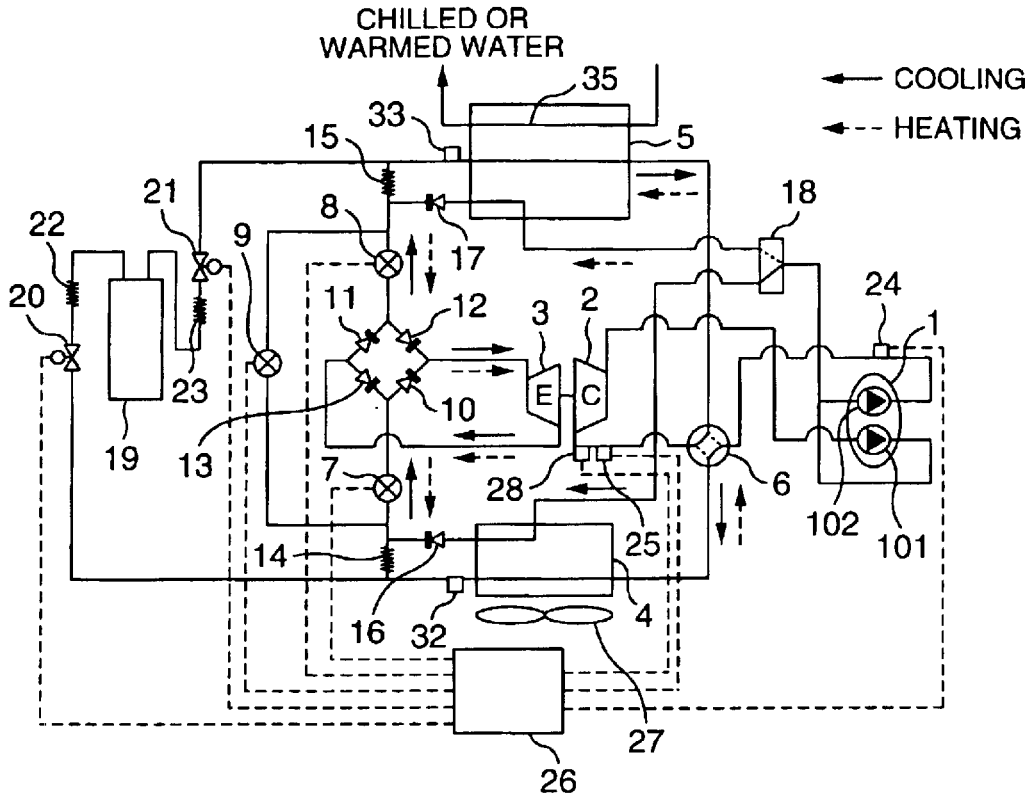
FIG. 1 is a refrigerant cycle structure view showing an embodiment of a refrigeration cycle apparatus in accordance with the present invention.

A description will be given below of a specific embodiment in accordance with the present invention with reference to the accompanying drawings. A description will be given of a first embodiment in accordance with the present invention on the basis of a refrigeration cycle structure view in FIG. 1. First, a description will be given of a flow and an operation of a refrigerant at a time of a cooling operation (in the case that a use side heat exchanger 5 is a cooler). In FIG. 1, the flow of the refrigerant at a time of the cooling operation is shown by a solid arrow. A main compressor (a first compressor) 1 is constituted by a two-stage compressor, for example, a 2-cylinder rotary compressor. A refrigerant under an intermediate pressure which is compressed by a first stage compression portion 101 of the main compressor partly flows to a second stage compression portion 102, and the rest thereof flows to a three-way valve (a refrigerant path changing means) 18, flows from the three-way valve 18 through a flow passage shown by a solid arrow, flows into a heat source side heat exchanger (a gas cooler) 4, and is partly heat exchanged with an air so as to be radiated. The refrigerant which is sucked into the second stage compression portion 102 so as to be compressed to a higher pressure and be discharged, flows through a four-way valve 6 in a direction of a solid arrow, and is exchanged heat with the air in the heat source side heat exchanger 4 so as to be radiated.

In the case that the refrigerant is a carbon dioxide refrigerant, if an outside air temperature is high, the refrigerant in a supercritical state flows within the heat source side heat exchanger 4. The heat source side heat exchanger 4 employs, for example, a finned tube type refrigerant-air heat exchanger, and heat exchanges by flowing the air by means of a fan 27. The heat source side heat exchanger 4 may be structured such that the refrigerant and water are exchanged heat.

The refrigerant in which the heat is radiated in the heat source side heat exchanger 4 is pressure reduced by a capillary tube 14, and is combined with the refrigerant in which the heat is radiated by passing through a part of the heat source side heat exchanger 4 from the intermediate pressure portion of the main compressor 1. A check valve 16 for preventing a back flow is provided in the flow passage from the intermediate pressure portion. The combined refrigerant pressure is reduced and the refrigerant is expanded to some extent by a first electric expansion valve 7, enters into an expanding device (an expanding portion of an expanding and compressing device) 3 via a check valve 10, and expands while applying an energy of the refrigerant to a rotating motion of the expanding device 3. A rotation axis of the expanding device 3 is directly connected to a rotation axis of a sub compressing device (a second compressor or a compressing portion of the expanding and compressing device) 2, and the sub compressing device 2 is driven. The expanding device and the sub compressing device may be received in one container.

The refrigerant expanded in the expanding device 3 is further expanded, the refrigerant pressure is reduced by a second electric expansion valve 8 and a capillary tube 15 via a check valve 11, and enters into the use side heat exchanger 5. Four check valves 10 to 13 serve as always setting a flowing direction of the refrigerant flowing to the expanding device 3 to a fixed direction in both of the cooling and heating operations. Further, a bypass flow passage provided with a third electric expansion valve 9 is arranged between an inlet side of the first electric expansion valve 7 and an outlet side of the second electric expansion valve 8, thereby circulating the refrigerant to the bypass flow passage provided with the electric expansion valve 9 so as to reduce the refrigerant pressure and expand the refrigerant, in the case that the operation of the expanding device 3 is not stable such as a starting time or the like, and the case that an excessive pressure drop is formed only by the flow passage passing through the expanding device 3 and a sufficient control can not be achieved. The refrigerant entering into the use side heat exchanger 5 evaporates so as to cool a water or the like corresponding to a secondary refrigerant 35. The refrigerant outgoing from the use side heat exchanger 5 enters into the sub compressor 2 so as to be compressed. The sub compressor 2 is rotated by the expanding device 3 which is driven by a recovered power. The refrigerant compressed by the sub compressor 2 is again sucked into the first stage compression portion 101 of the main compressor 1.

A refrigerant tank 19 is provided between the heat source side heat exchanger 4 and the use side heat exchanger 5, and the refrigerant is taken in and out with respect to the tank 19 by two-way valves 20 and 21, thereby keeping a total amount of the refrigerant circulating in the cycle proper. In order to get the refrigerant in the tank 19, a liquid refrigerant or a two-phase refrigerant which is pressure reduced by a capillary tube 22 is stored in the refrigerant tank 19 by opening the two-way valve 20, and in order to discharge the refrigerant from the tank, the refrigerant is discharged to a low pressure side of the cycle by opening the two-way valve 21. In accordance with the structure mentioned above, it is possible to adjust an amount of the refrigerant circulating in the refrigerant cycle.

Next, a description will be given of a flow and an operation of the refrigerant at a time of a heating operation with reference to FIG. 1. A flow of the refrigerant at a time of the heating operation is shown by a broken arrow. A part of the refrigerant having an intermediate pressure which is compressed by the first stage compression portion 101 of the main compressor 1 flows through a flow path shown by a broken line in the three-way valve 18, flows to a part of the use side heat exchanger 5, and is exchanged heat here with a secondary refrigerant 35 such as a hot water or the like so as to be heat radiated. The rest of the refrigerant having the intermediate pressure is compressed by the second stage compression portion 102 of the main compressor 1 so as to be discharged, and reaches the use side heat exchanger 5 through a flow path shown by a broken line in the four-way valve 6. Here, the refrigerant heat is radiated, and the refrigerant heats the secondary refrigerant such as the hot water or the like. The refrigerant pressure getting out from the use side heat exchanger 5 is reduced by the capillary tube 15, is combined with the refrigerant having the intermediate pressure which flows through the three-way valve 18, the refrigerant pressure is thereafter reduced and the refrigerant is expanded by the second electric expansion valve 8. A check valve 17 for preventing a back flow is provided in the path having the intermediate pressure.

The refrigerant getting out from the electric expansion valve 8 enters into the expanding device 3 through the check valve 12 so as to be further expanded. At this time, the energy of the refrigerant is recovered as a rotating motion of the expanding device 3. This matter is the same as that at a time of the cooling operation. The refrigerant pressure getting out from the expanding device 3 is further reduced in the first electric expansion valve 7 and the capillary tube 14 via the check valve 13, and the refrigerant reaches the heat source side heat exchanger 4. In the heat source side heat exchanger 4, the refrigerant removes heat from the air while evaporating. The refrigerant getting out from the heat source side heat exchanger 4 is sucked into the sub compressor 2 via the four-way valve 6 so as to be compressed. The refrigerant getting out from the sub compressor 2 is again sucked into the first stage compression portion 101 of the main compressor 1.

The refrigerant tank 19 is provided between the heat source side heat exchanger 4 and the use side heat exchanger 5, and the refrigerant is taken in and out with respect to the tank by the two-way valves 20 and 21. At a time of the heat operation, in the case of taking in the refrigerant to the refrigerant tank 19, the two-way valve 21 is opened, and in the case of taking out the refrigerant from the refrigerant tank 19, the two-way valve 20 is opened. In the manner mentioned above, it is possible to keep the amount of the refrigerant circulating in the cycle proper.

Figure 2:
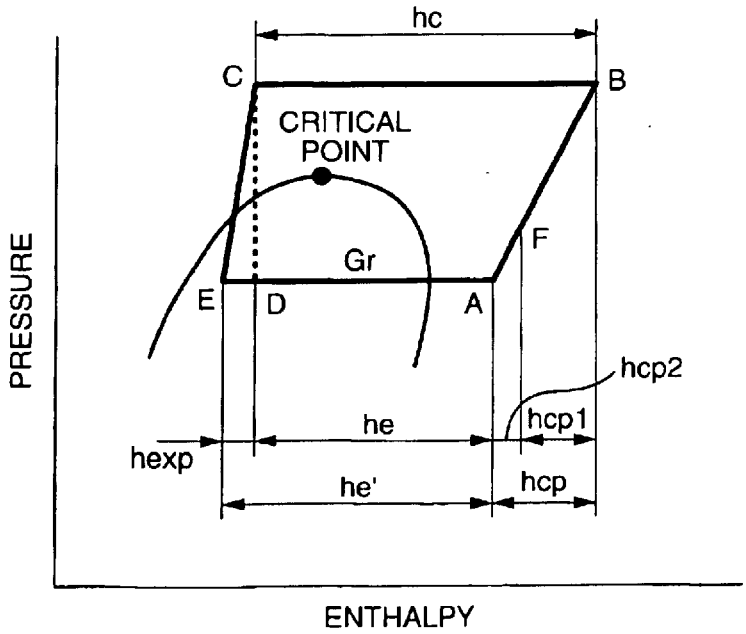
FIG. 2 is a Mollier diagram explaining an operation of a cycle with expander in the apparatus shown in FIG. 1.

A description will be given of an effect of the expanding and compressing devices in the refrigerant cycle apparatus in accordance with the present embodiment with reference to FIG. 2. FIG. 2 shows a Mollier diagram (a pressure-enthalpy diagram) of a supercritical refrigeration cycle such as a carbon dioxide refrigerant or the like. The supercritical cycle means a cycle in which a high pressure side pressure in FIG. 2 (a pressure from a point B to a point C) is more than a pressure in a critical point. In FIG. 2, a conventional normal supercritical cycle provided with no expanding device is shown by a broken line.

First, a description will be given of a cooling operation. An expanding process C–D is an isenthalpic change, and is vertical to an enthalpy axis. In the case that the expansion is carried out by the expanding device, the expanding process is shown by a line C–E in FIG. 2, and is close to the isenthalpic change. An evaporating capacity is shown by a value he in the case that no expanding device is provided, however, is shown by a larger value he' in the case that the expanding device is provided. Since a cooling capacity is expressed by a product of a refrigerant flow rate Gr and an enthalpy difference in an outlet and inlet port of the evaporator, the cooling capacity can be made larger by the provision of the expanding device. Further, since an enthalpy and a pressure obtained by the sub compressor change along a line A–F in FIG. 2 by using the energy recovered by the expanding device 3 as the power-of the sub compressor 2, and the enthalpy and the pressure change along a line F–B in the main compressor 1, the enthalpy difference of the main compressor 1 is reduced to a value hcp1 from a value hcp in the conventional cycle. Since the power of the main compressor is expressed by the product of the refrigerant flow rate Gr and the enthalpy difference in the outlet and inlet port of the main compressor, it is possible to reduce the power of the main compressor. A value hcp2 in FIG. 2 shows a component contributing to the power of the sub compressor 2, that is, the power reduction component of the main compressor 1, in the energy recovered by the expanding device 3. As mentioned above, since the cooling capacity is increased, and the power of the compressor is reduced, a coefficient of performance (COP) of the refrigeration cycle apparatus can be improved, and it is possible to achieve an energy-saving operation.

In the heating operation, since the enthalpy difference hc in the heating side is not changed by the expanding device, the heating capacity does not change, however, the power of the main compressor is reduced in the same manner as that at a time of the cooling operation. Accordingly, since the power of the compressor is lowered even at a time of the heating operation, the COP of the refrigeration cycle apparatus is improved, and it is possible to achieve an energy-saving operation.

Figure 3:
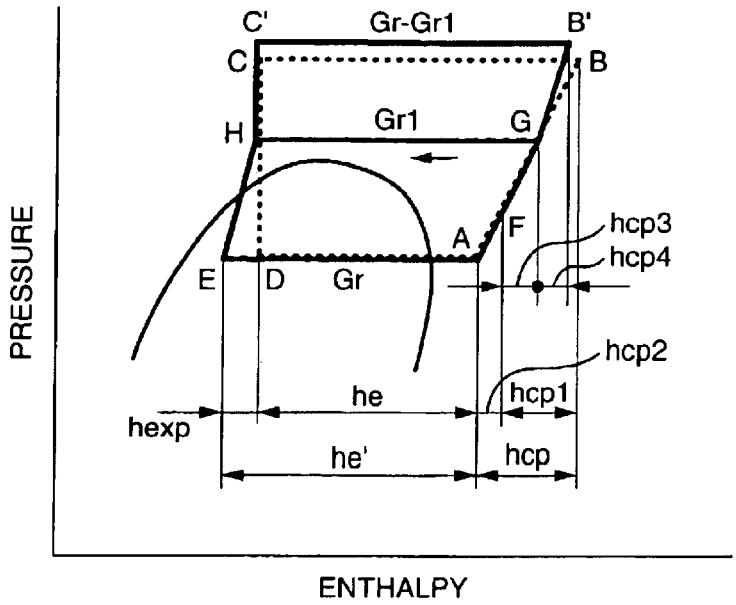
FIG. 3 is a Mollier diagram explaining an operation in the case that an intermediate pressure is controlled by a main compressor, in the apparatus shown in FIG. 1.

In the embodiment mentioned above, the main compressor 1 is constituted by the two-stage compressor, and a description will be given of an operation (an intermediate pressure control cycle) thereof with reference to FIG. 3. A part of the refrigerant is distributed into the heat exchanger 4 or corresponding to the high pressure side from an outlet of the first stage compression portion 101 of the main compressor, that is, an inlet (called as an intermediate pressure portion) of the second stage compression portion 102. On the assumption that a flow rate of the refrigerant flowing through the first stage compression portion 101 is set to Gr, and a flow rate of the refrigerant distributed into the high pressure side heat exchanger 4 or 5 from the intermediate pressure portion is set to Gr1, a flow rate of the refrigerant flowing through the second stage compression portion 102 is obtained by subtracting Gr1 from Gr, an enthalpy difference of the first stage compression portion becomes hcp3, and an enthalpy difference of the second stage compression portion becomes hcp4. It is possible to adjust the pressure difference of the first stage compression portion and the pressure difference of the second stage compression portion while keeping the discharge side pressure of the second stage compression portion uniform, by adjusting the refrigerant flow rate Gr1. It is possible to make a total of a refrigerant leak from the high pressure side to the low pressure side in each of the first stage and the second stage small, by making the pressure difference of the first stage compression portion approximately equal to the pressure difference of the second stage compression portion, and a volumetric efficiency and an overall adiabatic efficiency of the entire main compressor are improved. Accordingly, it is possible to reduce the power of the main compressor 1. The flow rate Gr1 of the refrigerant distributed in the intermediate pressure portion is adjusted by the capillary tube 14 or 15. In the case that a variable throttle such as an electric expansion valve or the like is employed in place of the capillary tube, it is possible to adjust the flow rate Gr1 in correspondence to various operation conditions, and it is possible to further improve the efficiency.

A description will be given of a function of the refrigerant tank 19 and the pressure reducing means (the capillaries) 22 and 23 shown in FIG. 1 with reference to FIGS. 1 and 4. The refrigerant tank 19 has a function of adjusting a total amount of the refrigerant circulating in the cycle by changing the amount of the refrigerant stored therein. The pressure in the high pressure side is changed by getting in and out the refrigerant with respect to the refrigerant tank 19. For example, in the case that the cooling operation is executed in accordance with a cycle ABCD shown by a solid line in FIG. 4, the pressure in the high pressure side is increased so as to be changed in accordance with a cycle AB'C'D' shown by a broken line, by opening the low pressure side valve 21 so as to discharge the refrigerant in the refrigerant tank 19 into the cycle operating the refrigerant. On the assumption that the temperature in the outlet side of the heat source side heat exchanger corresponding to the heat radiator is uniform at a time of the cooling operation, the change from the point C to the point C1 is along a constant temperature line. At this time, the enthalpy difference in the outlet and inlet port of the use side heat exchanger (the evaporator at a time of the cooling operation) is changed to Δhe' from Δhe in FIG. 4, and the enthalpy difference in the outlet and inlet port of the compressor is changed to Δhcp' from Δhcp. The COP expressing the performance of the refrigeration cycle is obtained by dividing the enthalpy difference in the outlet and inlet of the evaporator by the enthalpy difference in the outlet and inlet of the compressor. Accordingly; the COP is changed to Δhe'/Δhcp' from Δhe/Δhcp.

Figure 4:
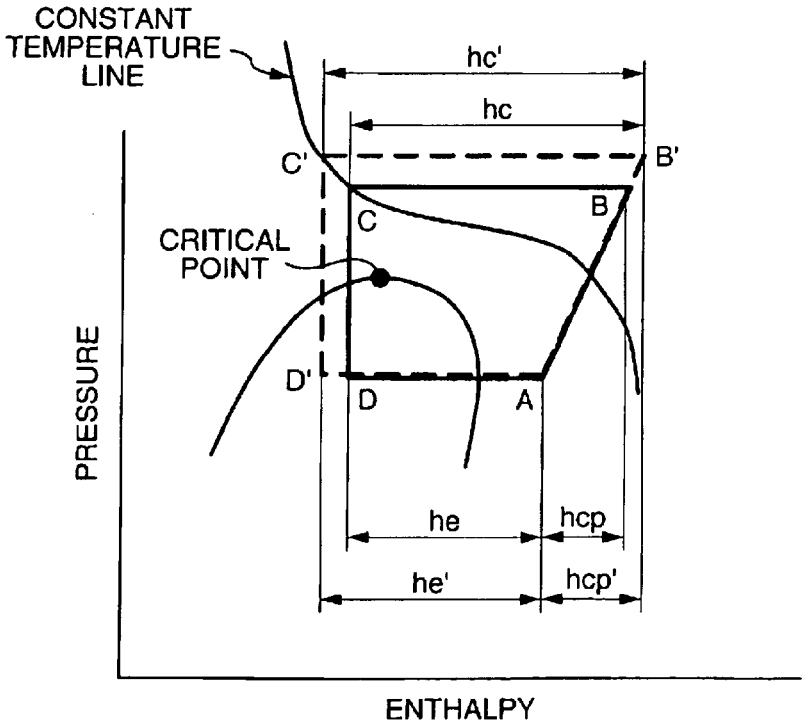
FIG. 4 is a Mollier diagram explaining an effect of a refrigerant tank in the apparatus shown in FIG. 1.

Since a gradient of the constant temperature line in FIG. 4 is not uniform, and an isentropic curve at a time of compression is changed, the value of the COP is changed on the basis of the pressure in the high pressure side, and a high pressure side pressure where the COP is maximum exists. Accordingly, temperature sensors 32 and 33 for detecting the temperature are provided in an outlet of the heat exchanger corresponding to the heat radiator, and data of the compressor discharge pressure at which the COP is maximum are previously taken in correspondence to the outlet refrigerant temperature of the heat radiator (the heat source side heat exchanger 4 at a time of the cooling operation, and the use side heat exchanger 5 at a time of the heating operation) so as to be stored in the memory apparatus of the control apparatus 26. The amount of the refrigerant within the tank is controlled such that the compressor discharge pressure becomes a target value, by comparing a proper pressure in correspondence to the temperature detected by the temperature sensor 32 or 33, with the pressure detected by the compressor discharge pressure sensor 24, and adjusting the opening ratio of the opening time of the valve 20 or 21 in correspondence to the difference. It is possible to properly control the discharge pressure in accordance with the control, and it is possible to obtain a high COP.

In order to prevent the control from being unstable due to the rapid change of the refrigerant amount within the tank, the capillary tubes (the pressure reducing means) 22 and 23 are provided in the present embodiment. In this case, in the case that the electric expansion valve is employed in place of the capillary tubes 22 and 23, it is possible to achieve a more fine control of the refrigerant amount.

Next, a description will be given of a control of the electric expansion valves 7, 8 and 9. In the case of the cooling operation, in normal, the opening ratio of the first expansion valve 7 is controlled, the second expansion valve 8 is fully opened, and the third expansion valve 9 is fully closed. The control apparatus 26 controls the expansion valve 7 in such a manner that a difference between a suction temperature detected by a suction refrigerant temperature sensor 25 of the sub compressor 2 and a saturation temperature corresponding to a pressure detected by a sub compressor suction pressure sensor 28, that is, a suction superheat of the sub compressor becomes a target value.

In the case that the superheat is larger than the predetermined value even when the expansion valve 7 is fully opened, the third expansion valve 9 is controlled by the control apparatus 26, thereby controlling the suction superheat of the sub compressor.

In the case of the heating operation, in normal, the opening ratio of the second expansion valve 8 is controlled, the first expansion valve 7 is fully opened, and the third expansion valve 9 is fully closed. The opening ratio of the second expansion valve 7 is controlled in accordance with the suction superheat of the sub compressor 2 in the same manner as that of the cooling operation. In the case that the superheat is larger than the predetermined value even when the second expansion valve 8 is fully opened, the control apparatus 26 can control the suction superheat of the sub compressor by controlling the third expansion valve 9 of the bypass circuit.

In this case, in place of the suction superheat of the sub compressor, the target value of the discharge temperature of the sub compressor is defined in correspondence to a rotational speed of the sub compressor and an outside air temperature, the first expansion valve 7 is controlled such that the discharge temperature becomes the target value, and in the case that the discharge temperature is higher than the target value even when the expansion valve 7 is fully opened, it is possible to control by means of the third expansion valve 9 such that the discharge temperature becomes the target value.

In the present embodiment, a description will be given of an aspect such as a heat pump type water chilling unit in which the use side heat exchanger 5 is exchanged heat with a chilled or warmed water as an example, however, the use side heat exchanger may be constituted by a heat exchanger which exchanges heat with the air, such as a package air conditioner.

In accordance with the present embodiment, since the energy recovered by the expanding device 3 is utilized for the power of the sub compressor 2, it is possible to reduce an energy consumption such as an electric power of the refrigeration cycle apparatus. Further, since the sub compressor 2 directly connected to the expanding device 3 is provided in addition to the main compressor 1, it is possible to restrict the heat leak from the compressor side to the expanding device side small, and it is possible to secure a high efficiency. Further, in accordance with the present embodiment, it is possible to improve an efficiency of the compressor and it is possible to reduce the energy consumption, by controlling the intermediate pressure portion of the main compressor 1 to the proper pressure. Further, it is possible to properly adjust the amount of the refrigerant in the refrigeration cycle, whereby it is possible to improve the efficiency of the refrigeration cycle and it is possible to reduce energy consumption.

Figure 5:
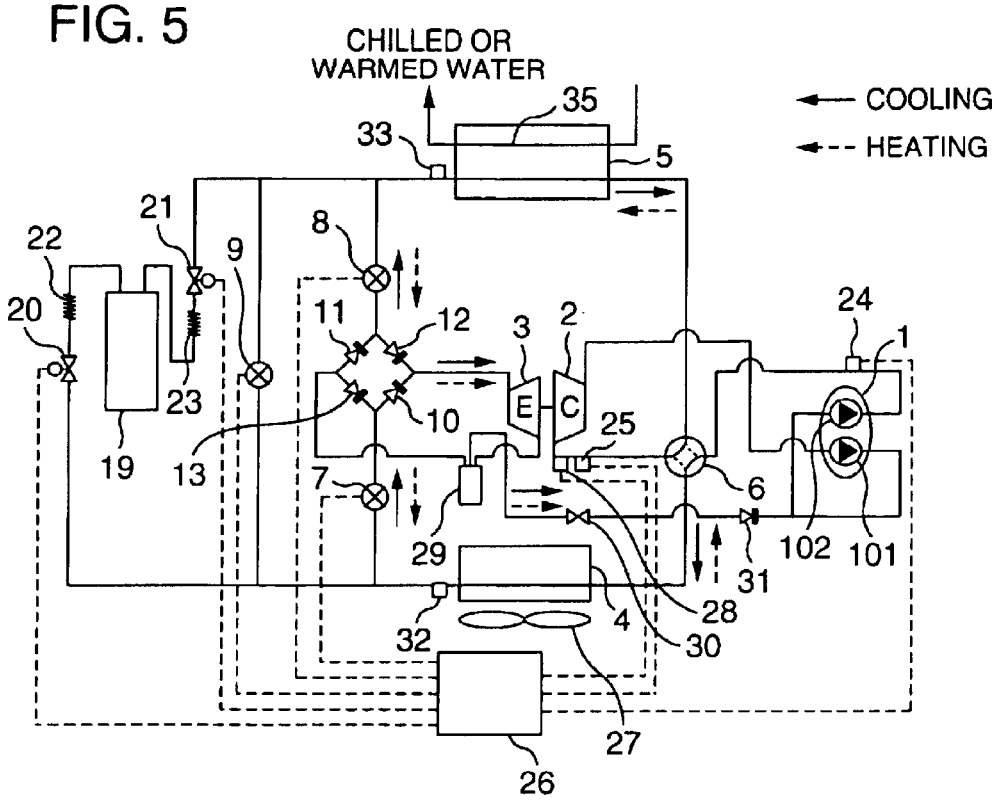
FIG. 5 is a refrigerant cycle structure view explaining another embodiment of a refrigeration cycle apparatus in accordance with the present invention.

A description will be given of another embodiment in accordance with the present invention with reference to FIG. 5. In FIG. 5, the structure is different from the embodiment shown in FIG. 1 in a point that a gas-liquid separator 29 is provided in the outlet of the expanding device 3, and there is employed a gas injection cycle which injects the gas refrigerant separated by the gas-liquid separator 29 to the intermediate pressure portion of the main compressor 1, that is, at the midpoint of the first stage compression portion 101 and the second stage compression portion 102.

First, a description will be given of an operation of the gas injection cycle at a time of the cooling operation. In FIG. 5, a solid arrow shows a flow of the refrigerant at a time of the cooling operation. The refrigerant getting out from the second stage compression portion 102 of the main compressor 1 flows through the four-way valve 6 in a direction of a solid line, and is heat radiated by the outside air in the heat source side heat exchanger 4 so as to be cooled. The refrigerant getting out from the heat source side heat exchanger 4 passes through the first electric expansion valve 7. The electric expansion valve 7 is fully opened or is adjusted to a slightly throttled opening ratio. The refrigerant from the electric expansion valve 7 enters into the expanding device 3 through the check valve 10, and an energy thereof is recovered while being expanded. The refrigerant getting out from the expanding device 3 enters into the gas-liquid separator 29, and is separated into the gas and the liquid. The separated gas refrigerant is injected to the intermediate pressure portion of the main compressor 1 through a two-way valve 30 and a check valve 31 out of a middle pipe of the gas-liquid separator 29. The liquid refrigerant pressure separated in the gas-liquid separator 29 is reduced and the refrigerant expanded in the second electric expansion valve 8 through the check valve 11 out of a left pipe in the drawings, and is evaporated and removes heat in the use side heat exchanger 5 so as to cool the cooling water corresponding to a secondary refrigerant 35. The refrigerant getting out from the use side heat exchanger 5 is compressed by the sub compressor 2 through a solid flow passage shown by a solid line in the four-way valve, and reaches the main compressor 1. In the main compressor 1, the refrigerant is compressed to the intermediate pressure by the first stage compression portion 101, is combined with the refrigerant gas from the gas-liquid separator 29, is sucked into the second stage compression portion 102, and is further compressed so as to be discharged.

In the case of the heating operation, the refrigerant flows in a direction of an arrow shown by a broken line in FIG. 5, and the refrigerant is heat radiated in the use side heat exchanger 5, and is evaporated and removes heat in the heat source side heat exchanger 4. Since a basic operation is the same as the case of the cooling operation mentioned above, a description thereof will be omitted.

Figure 6:
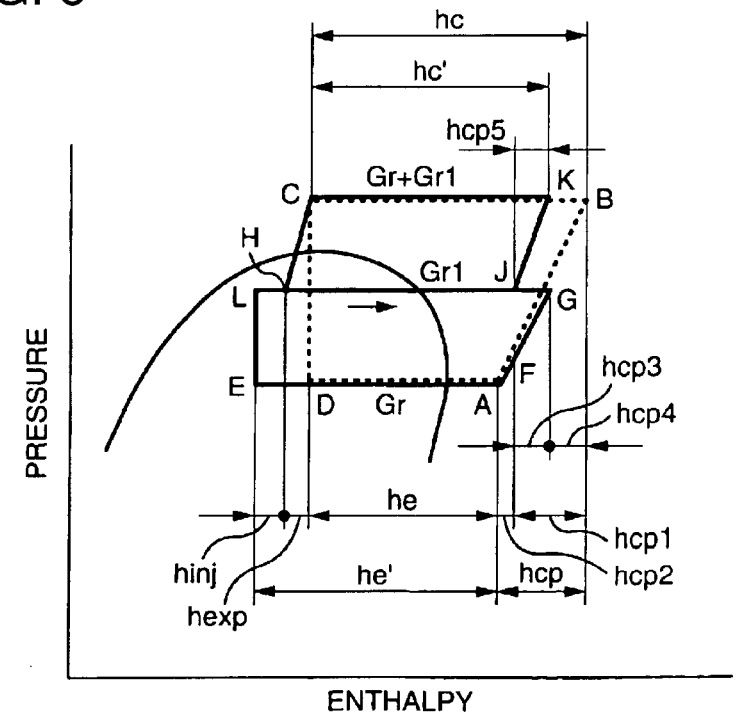
FIG. 6 is a Mollier diagram explaining an operation of a refrigeration cycle in the embodiment shown in FIG. 5.

A description will be given of an effect of the expanding device 3 and the gas injection circuit in accordance with the embodiment in FIG. 5, with reference to a Mollier diagram in FIG. 6. The refrigerant is assumed as a refrigerant which is supercritical in the high pressure side, such as a carbon dioxide refrigerant or the like. A broken line shown in FIG. 6 expresses the case of the conventional refrigerant cycle apparatus provided with no expanding device and no injection circuit, and is the same as that described in FIG. 2. Accordingly, a description thereof will be omitted here. The structure shown by a solid line in FIG. 6 corresponds to the present embodiment, and in this drawing, a point A corresponds to a suction of the sub compressor 2. The compression is executed from the point A to a point F in the sub compressor 2, and the compression is executed further by the first stage compression portion 101 of the main compressor 1 so as to reach a point G from the point F in the drawing. The refrigerant is combined with the refrigerant gas from the gas-liquid separator 29 in the outlet of the first stage compression portion 101, and the enthalpy is lowered to a point J. The refrigerant is further compressed in the second stage compression portion 102 of the main compressor 1 from this point, and reaches to a point K. From the point K to a point C, the heat of the refrigerant is radiated in the heat source side heat exchanger 4 at a time of the cooling operation, and in the use side heat exchanger 5 at a time of the heating operation. Next, the refrigerant is expanded in the expanding device 3, and the enthalpy and the pressure are lowered so as to reach a point H.

The gas refrigerant separated in the gas-liquid separator 29 is injected to the intermediate pressure portion of the main compressor 1. This is expressed by a path from the point H to the point J. The liquid refrigerant is lowered in the enthalpy to a point L, and is further expanded and pressure reduced in the electric expansion valve 7 or 8 so as to reach a point E. From the point E to the point A, the refrigerant is evaporated and removes heat in the use side heat exchanger 5 at a time of the cooling operation and in the heat source side heat exchanger 4 at a time of the heating operation so as to reach the point A, whereby one cycle is completed.

In accordance with the present embodiment, the following effects can be obtained in the cooling operation. In other words, in FIG. 6, the refrigerant flow rate in the low pressure side (the use side heat exchanger 5 side) is Gr which is the same as that of the conventional cycle, however, the enthalpy difference he of the outlet and inlet in the use side heat exchanger of the conventional cycle is increased at a sum of an effect hexp by the expanding device 3 and an effect hinj by the gas injection so as to become he'. Accordingly, the cooling capacity corresponding to the product of the enthalpy difference in the outlet and inlet of the evaporator and the refrigerant flow rate is increased.

On the other hand, the enthalpy difference of the first stage compression portion 101 of the main compressor is reduced from the conventional cycle at an active component hcp1 in the power of the sub compressor 2 recovered by the expanding device so as to become hcp3, whereby it is possible to reduce the input of the first stage compression portion of the main compressor. In the second stage compression portion 102 of the main compressor, the refrigerant flow rate is increased to an amount Gr+Gr1 from an amount Gr in the conventional cycle, however, the enthalpy difference is reduced to a value hcp5 from a value hcp4. Since the input (the compressor power) corresponds to the product of the refrigerant flow rate and the enthalpy difference in the outlet and inlet of the compressor, the input obtained by combining the first stage and second stage compression portions is reduced. Since the cooling capacity is increased, and the input of the main compressor is reduced, the coefficient of performance (COP) is improved, and the energy-saving operation can be achieved.

In the case of the heating operation, the refrigerant circulating amount in the high pressure side (the use side heat exchanger 5 side) is increased to the amount Gr+Gr1 from the amount Gr, and the enthalpy difference is reduced to the value hc' from the value hc. In normal, since a percentage increase of the refrigerant circulating amount is larger than a percentage decrease of the enthalpy, the heating capacity is increased. The input is reduced in the same manner as that of the case of the cooling operation. Accordingly, the COP is also improved at a time of the heating operation, and the energy-saving operation can be achieved.

In accordance with the embodiment shown in FIG. 5, since the energy recovered by the expanding device is utilized as the power of the sub compressor, it is possible to reduce the energy consumption of the refrigerant cycle apparatus. Further, in accordance with the present embodiment, since the gas refrigerant separated by the gas-liquid separator provided in the outlet of the expanding apparatus is injected to the intermediate pressure portion of the main compressor, the efficiency of the refrigeration cycle is improved, and it is possible to reduce the energy consumption.

As described above, in accordance with the present invention, since the structure is made such that the sub compressor independently provided from the main compressor is driven by utilizing the recovered energy by the expanding device, it is possible to reduce the heat leak from the main compressor to the expanding device, and it is possible to widely improve the efficiency of the refrigerant cycle apparatus, so that there is an effect that the energy-saving operation is achieved.

Further, since the control is executed by the provision of the first to third expansion valves, it is possible to keep the pressure difference between the inlet and the outlet of the expander and the flow rate of the refrigerant flowing through the expanding device proper.

Further, in the structure in which the two-stage compressor is employed as the main compressor, the main compressor discharge side pressure can be set to the proper pressure by bypassing a part of the discharge pressure (the intermediate pressure portion) of the first stage compression portion to the radiator side, or injecting the gas refrigerant separated into the gas and the liquid in the downstream side of the expanding device to the intermediate pressure portion.

Further, it is possible to properly control the amount of the refrigerant circulating in the refrigerant cycle, by the provision of the refrigerant tank.

It should be further understood by those skilled in the art that the foregoing description has been made on embodiments of the invention and that various changes and modifications may be made in the invention without departing from the spirit of the invention and the scope of the appended claims.

What is claimed is:

1. A refrigeration cycle apparatus comprising:

a first compressor;

an expander;

a second compressor directly connected to a rotation axis of said expander;

a use side heat exchanger;

a heat source side heat exchanger;

a four-way valve; and said refrigeration cycle apparatus changing a cooling operation and a heating operation of said use side heat exchanger by means of said four-way valve, wherein a refrigeration cycle is constituted by sequentially connecting said first compressor, said four-way valve, said heat source side heat exchanger, said expander, said use side heat exchanger and said second compressor, wherein said refrigeration cycle is provided with a first expansion valve arranged between said expander and said heat source side heat exchanger, and a second expansion valve arranged between said expander and said use side heat exchanger, and wherein a rectifying means for always circulating a refrigerant in an inlet side of the expander is provided between said first and second expansion valves and said expander.

2. A refrigeration cycle apparatus as claimed in claim 1, wherein the refrigeration cycle apparatus connects between said first expansion valve in the side of the heat source side heat exchanger and said second expansion valve in the side of the use side heat exchanger, via a third expansion valve.

3. A refrigeration cycle apparatus as claimed in claim 2, wherein the refrigerant cycle apparatus fully opens any one of said first expansion valve and said second expansion valve and fully closes said third expansion valve in the case that a difference between a suction temperature of said second compressor and a saturation temperature in correspondence to a suction pressure of said second compressor is equal to or less than a predetermined value, and fully opens both of said first expansion valve and said second expansion valve and adjusts the third expansion valve to the other opening ratio than the fully closed opening ratio in the case that the difference between the suction temperature of said second compressor and the saturation temperature in correspondence to the suction pressure of said second compressor is equal to or more than the predetermined value.

4. A refrigerant cycle apparatus comprising:

a two-stage compressor having a first stage compression portion and a second stage compression portion;

a use side heat exchanger;

a pressure reducing apparatus;

a heat source side heat exchanger;

a four-way valve; and said refrigeration cycle apparatus changing a cooling operation and a heating operation of said use side heat exchanger by means of said four-way valve, wherein a discharge flow passage of the first stage compression portion of said two-stage compressor is branched, one is connected to a suction flow passage of said second stage compression portion, and another is connected to a flow passage changing means such as a three-way valve or the like for changing a flow passage to said use side heat exchanger and a flow passage to said heat source side heat exchanger.

5. A refrigerant cycle apparatus comprising:

a compressor;

a use side heat exchanger;

a heat source side heat exchanger; and an expanding means, wherein the refrigeration cycle apparatus comprises:

a refrigerant tank provided in parallel to said expanding means;

two flow passages for taking in and out the refrigerant with respect to said refrigerant tank;

valves respectively provided in said flow passages;

a temperature detecting device provided in an outlet side of the heat source side heat exchanger at a time of a cooling operation, or in an outlet side of the use side heat exchanger at a time of a heating operation;

a pressure detecting device for detecting a discharge pressure of said compressor; and a control apparatus for opening and closing said two valves or controlling opening ratio of said two valves on the basis of a temperature detected by said temperature detecting device, and a pressure detected by said pressure detecting device.

6. A refrigeration cycle apparatus comprising:

a first compressor:

an expander:

a gas-liquid separator provided in an outlet of said expander;

a flow passage for injecting a gas separated by the gas-liquid separator to said first compressor;

a second compressor directly connected to a rotation axis of said expander;

a use side heat exchanger; and a heat source side heat exchanger, wherein said second compressor is provided in an upstream side of said first compressor.

7. A refrigeration cycle apparatus as claimed in claim 6, wherein a carbon dioxide is employed as the refrigerant constituting the refrigerant cycle.

* * * * *